US005337645A

United States Patent [19]

Johnston

[11] Patent Number: 5,337,645

[45] Date of Patent: Aug. 16, 1994

[54] MUSICAL DRUM MOUNT WITH CIRCUMFERENTIALLY ADJUSTABLE INSULATING SUPPORTS

[75] Inventor: Walter S. Johnston, Brooklyn Center, Minn.

[73] Assignee: Purecussion, Inc., St. Louis Park, Minn.

[21] Appl. No.: 969,341

[22] Filed: Oct. 30, 1992

[51] Int. Cl.[5] ..... G10D 13/02

[52] U.S. Cl. ..... 84/421

[58] Field of Search ..... 84/421; 248/215

[56] References Cited

U.S. PATENT DOCUMENTS

| | | | |
|---|---|---|---|
| 2,433,594 | 12/1947 | Calo | 84/421 |
| 2,707,610 | 5/1955 | Fillion et al. | 248/215 |
| 2,990,745 | 7/1961 | Casavant | 84/421 |
| 3,106,123 | 10/1963 | Johannsen | 84/421 |
| 3,191,484 | 6/1965 | Walling | 84/421 |
| 3,405,587 | 10/1968 | Meazzi et al. | 84/421 |
| 3,608,418 | 9/1971 | Chaffee et al. | 84/421 |
| 3,945,291 | 3/1976 | Zickos | 84/421 |
| 4,158,980 | 6/1979 | Gauger | 84/421 |
| 4,185,808 | 1/1980 | Donohoe et al. | 248/295 R |
| 4,252,047 | 2/1981 | Gauger | 84/421 |
| 4,356,757 | 11/1982 | Mooy | 84/411 R |
| 4,519,289 | 5/1985 | Gauger | 84/421 |
| 4,593,596 | 6/1986 | Gauger | 84/421 |
| 4,596,176 | 6/1986 | Gauger | 84/421 |
| 4,688,463 | 8/1987 | Kurosaki | 84/421 |
| 4,870,883 | 10/1989 | Gauger | 84/413 |
| 5,076,132 | 12/1991 | Hsieh | 84/421 |

FOREIGN PATENT DOCUMENTS 3111895 5/1991 Japan .

*Primary Examiner*—Richard A. Wintercorn
*Assistant Examiner*—P. Stanzione
*Attorney, Agent, or Firm*—Schroeder & Siegfried

[57] ABSTRACT

A musical drum mount including a rigid but flexible band which is independent and disconnected from the drum, and which extends circumferentially therearound to support the drum from a conventional supporting structure. The rigid band carries a plurality of circumferentially adjustable insulating supports which extend radially inward from the band so as to engage the drum and support the same within the band without being physically connected thereto. Each of the moveable insulating supports have a drum bearing surface which insulates the drum from the grounding effect of the floor stand or other supporting structure therefor, and engages the drum to support the same above ground level. The circumferential movement of the insulating supports provides versatility of use with a variety of different conventional drum structures having various placement of head tightening lugs therearound. The rigid band is diametrically adjustable so as to accommodate a number of differently sized drums.

31 Claims, 6 Drawing Sheets

3
1
29
37
51
64
31
55
35
39
41
65
21
21
43
49
61
47
59
7
33
63
11
53
45
57

53
51
45
67
33
57
47
59
43
65
65
37
39
35
21
31
55

MUSICAL DRUM MOUNT WITH CIRCUMFERENTIALLY ADJUSTABLE INSULATING SUPPORTS

BACKGROUND OF THE INVENTION

The invention described and claimed herein is related generally to the field of musical drums, and more particularly to devices for supporting rack mounted toms and floor toms above the floor from a stand or other supporting structure.

Generally, drums of the type having outer cylindrical shells, such as rack mounted toms and floor toms, are single or double-headed drums which include a plurality of circumferentially spaced head tightening lugs mounted on the outer surface of the shell. Such a drum generally has a top batter head, and may also include a bottom head. A counter hoop extends circumferentially around the drum adjacent each head thereof, and is used for tightening and tuning such heads. Each counter hoop has a plurality of flanges which cooperatively align with the tightening lugs, and secure thereto via an adjustable bolt which may be tightened and loosened as desired for proper tuning.

Conventional single or double-headed musical drums generally include rigid mounts that are bolted to the shell or head tightening lugs of the drum, or alternatively, affixed to a plate which is secured to the drum. Such mounts are designed to receive and connect to a tom arm, which is used to suspend the drum from a stand, rack or bass drum holder. Alternatively, multiple mounts have been used to receive supporting legs in the case where the drum is used as a floor tom.

More recently, another means for supporting such musical drums has emerged. Such a drum is supported through the use of a circular or semicircular supporting bracket which is fixedly attached to the shell of the drum via securement to the head tightening lugs thereof. Such brackets generally have protruding flanges which are cooperatively aligned with and sandwiched between the head tightening lugs and the counter hoop of the drum, and held in position by the adjustable head tightening bolt which secures the same. Such brackets, in turn, are supported above ground level by a supporting structure, such as a floor stand or rack.

The problem with mounting brackets of this type is that they cannot be removed without complete disassembly of the counter hoop from each head tightening lug to which it is attached. Once the bracket is removed, the counter hoop must be reassembled, and the drum head retuned, before the drum can be used. Such a system is extremely labor intensive and cumbersome. Examples of such mounted drums are shown in U.S. Pat. No. 4,158,980, issued to Gauger on Jun. 26, 1979, and U.S. Pat. No. 4,519,289, issued to Gauger on May 28, 1985.

In considering the instant invention, it must be appreciated that there are numerous different sizes and models of musical drums available from many different manufacturers, most of which are not universally designed, and many of which are designed with the head tightening lugs spaced differently about the circumference thereof. As such, numerous special mounting brackets must currently be manufactured for use with the numerous different types of drums available.

For example, a 12" diameter rack mounted tom may include 5, 6, or 8 head tightening lugs, which may be mounted at differently spaced locations about the circumference of the shell of the drum, depending upon which manufacturer has produced the same. As drum sizes can range from 6" to 20" in diameter, with various numbers of lugs mounted thereon, it can be appreciated that a large number of mounting brackets must be maintained, which is labor intensive for the manufacturer and requires maintenance of inventory levels which is economically impractical. On occasion, and without notice, manufacturers will also change the number of lugs used on a particular drum size, which further complicates bracket inventory levels which must be maintained.

Other problems associated with conventional rack mounted toms include the fact that such mounting brackets, when fixed to the head tightening lugs of the drums, enlarge the overall drum size so that the same is difficult or impossible to fit within a standard drum case therefor. But, as previously discussed, in order to remove such a mounting bracket from the head tightening lugs, it is necessary to remove the counter hoop, thereby loosening the batter and/or bottom head, and making it necessary to retune the drum upon reassembly thereof.

Also, repositioning of the mounting bracket on different lugs of a particular drum has been found to oftentimes improve the tuning effectiveness of the drum. However, in order to effect such a repositioning of the mounting brackets relative to the drum lugs, a trial-by-error process is necessary which is time consuming and requires disassembly, reassembly and retuning with each change. Such repositioning of the mounting bracket also uncovers scarring of the drum which is sometimes present due to aftermarket adaptation of a drum for usage of such brackets.

As is evident from the above, there is a distinct need for a mounting bracket which exists independently of the drum, and which is capable of supporting a drum at any of a variety of different locations therearound, so as to eliminate the need for fine tune adjustment and alignment with the various lugs mounted on a particular drum. Such a mounting system must provide ease of removal of the drum therefrom, without requiring retuning, and must be versatile and capable of functioning with a plurality of different sizes and constructions of such drums. As will be shown hereinafter, the instant invention solves the above problems which are related to conventional drum mounting systems, and provides a feasible and cost effective solution for accomplishing the same.

BRIEF SUMMARY OF THE INVENTION

It is therefore an object of the present invention to provide a highly versatile musical drum mounting bracket which is independent from the drum itself and provides an effective, inexpensive, and efficient means for supporting a plurality of different varying sizes of drums without the need for using a plurality of different drum mounting brackets.

It is a further object of the present invention to provide a versatile musical drum mounting bracket which is not dependent upon the location of the head tightening lugs mounted on the drum, and which is readily restructurable so as to be capable of supporting the drum at a multitude of varying positions without the need for disassembly and retuning of the drum.

In accordance with the present invention, a relatively rigid but flexible band having opposite free ends extends circumferentially around the outer shell of a conventional drum. Each opposite end of the band has a plurality of openings extending therethrough which cooperatively mate in communicating relation with a plurality of mounting holes in a mounting plate. Bolting the opposite ends to the mounting plate retains the band in its annular configuration.

The mounting plate, in turn, adjustably connects to a supporting structure for supporting the same. The opposite ends of the rigid band may be moved toward or away from each other, and overlap if necessary, to adjust the relative diameter of the band. In this manner, one band may be utilized in connection with a number of drums having varying sizes of shell diameters. As used hereinafter, the phrase "rigid but flexible" means the band is strong enough to support the weight of a musical drum, yet flexible enough that the band can be annularly formed and adjusted to change the diametric size thereof.

The mounting band is constructed to carry a plurality of insulating supports thereon which may be movably adjusted along the circumference of the band and disposed at any of a multitude of varying positions. Each insulating support is preferably constructed of an insulating plastic or rubber material, and extends radially inward from the band and supports the drum in disconnected non-clamping relation at a desired location therearound. As used hereinafter, the phrase "non-clamping relation" means that the insulating supports are devoid of any direct physical fixed connection to the musical drum which they support.

In one embodiment, the insulating supports are comprised of a pair of mounts which are carried by the mounting band. The mounts straddle the upper and lower edges of the band and are interconnected by a tightening bolt extending therebetween. Such mounts are constructed of an insulating type material, and are capable of supporting a drum from its upper or lower counter-hoop.

In another embodiment, each insulating support may include a generally central opening or downwardly extending slit through which the band extends, so as to carry the support in movable relation therealong. A tapered drum bearing surface of each insulating support, which may alternatively be constructed of an elastomeric insulating material, reduces the resonant grounding effect of the supporting structure. Each insulating support also includes a tightening means, such as a set screw, which is used to lock the support at any desired position along the circumference of the band.

Through the use of my diametrically adjustable mounting band with readily movable insulating supports, the shell of a drum may be received within the circumferential confines of the band, and bear against the drum bearing surface of each of the insulating supports carried thereby. Each of the insulating supports will engage and support the drum in non-clamping insulating relation, thereby maintaining the mounting band independent from the drum and devoid of any physical connection thereto. By so doing, a high degree of versatility is maintained as to the various different models and type of drums with which the mount may be used, which will effectively reduce the cost and labor intensive necessity of maintaining numerous different mounting brackets for different models and sizes of drums.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
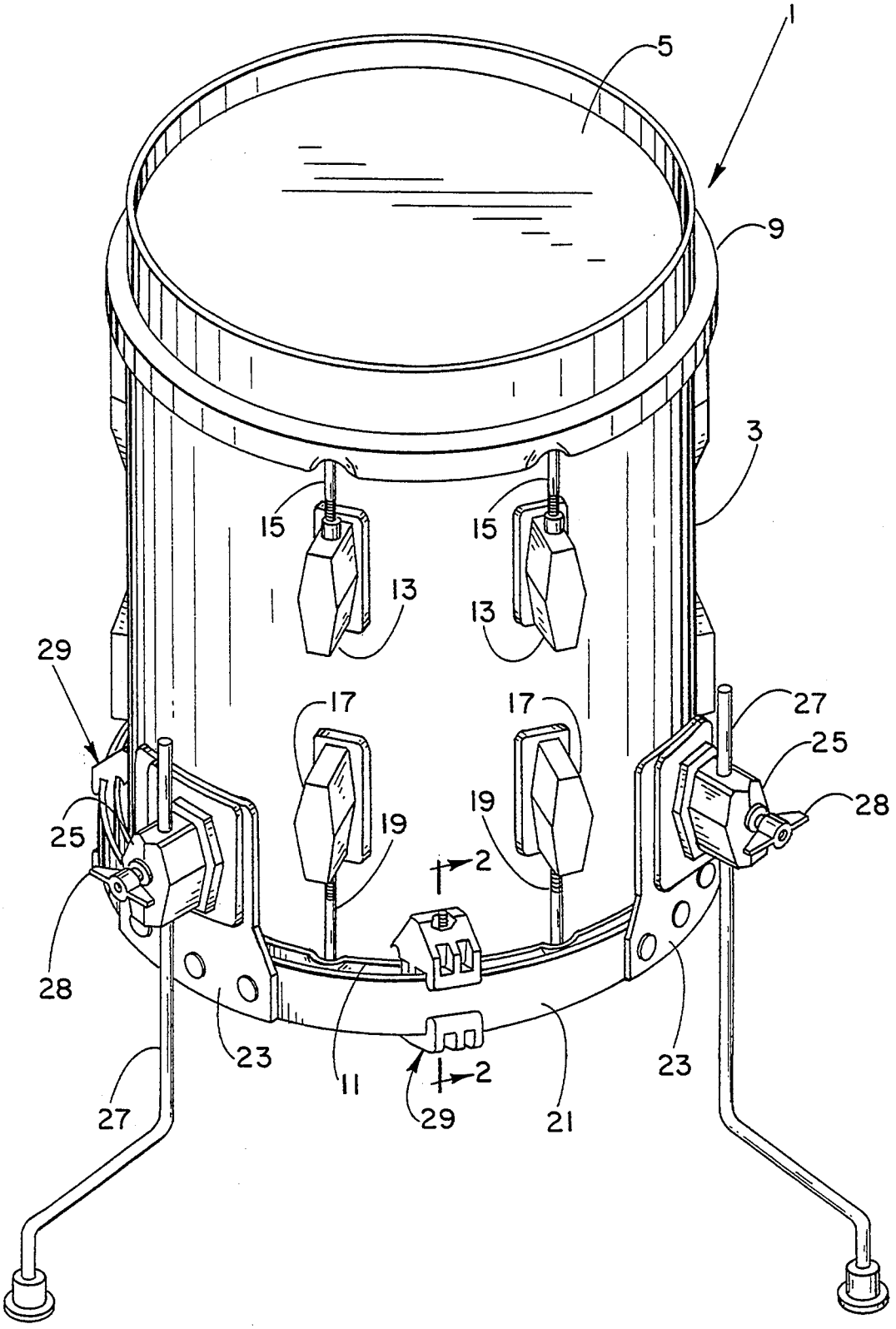
FIG. 1 is a perspective view of my new musical drum mounting bracket supporting a conventional drum from its lower counter hoop at a point intermediate the head tightening lugs thereof.

Shown in FIG. 1 is a conventional musical drum 1, such as a floor tom, which is comprised of an outer circumferential shell 3 which carries a top batter head 5 and a bottom head 7 so as to enclose the area within the confines of outer shell 3. The peripheral portions of batter head 5 and bottom head 7 are secured within a flesh hoop (not shown) which encircles the upper and lower portion of shell 3, respectively. An upper counter hoop 9 extends over the flesh hoop for batter head 5 and is secured at a plurality of locations to head tightening lugs 13 by an adjustable bolt 15. Tightening and tuning of the batter head 5 is accomplished by adjusting bolts 15 to tighten or loosen the batter head as desired. Similarly, a lower counter hoop 11 extends over the flesh hoop for the bottom head and is secured to similar head tightening lugs 17 via adjustable bolts 19.

Figure 2:
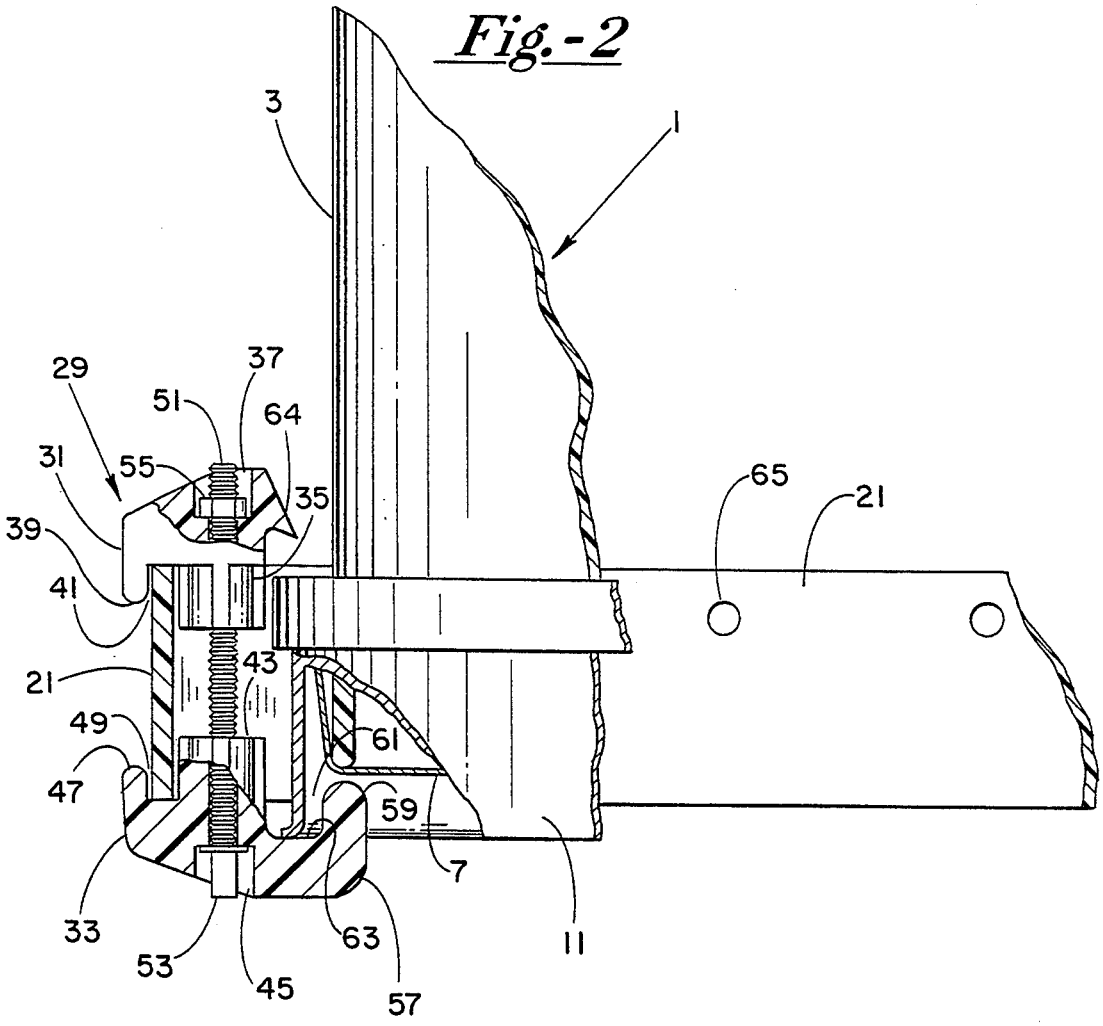
FIG. 2 is a cross-section of FIG. 1 taken along lines 2—2 and showing the manner in which the musical drum is supported by adjustable insulating supports.

My new mounting bracket for such conventional musical drums is comprised generally of a relatively rigid but flexible annular band 21 which extends around drum 1 and is supported above ground level through the use of one or more mounting plates 23 which carry mounting clamps 25. Clamps 25 have openings 26 which receive a supporting structure, such as legs 27, therethrough. Clamps 25 are vertically adjustable on the supporting legs 27, and can be positioned at a desirable height by tightening locking mechanism 28. A plurality of circumferentially adjustable insulating drum support members 29 are movably carried by band 21, and support the drum 1 in disconnected non-clamping relation by one of the counter hoops, 9 or 11, thereof. As shown in FIGS. 1 and 2, the musical drum 1 is supported by a plurality of adjustable insulating supports 29 which engage the bottom counter hoop 11 in disconnected and non-clamping relation.

As shown best in FIGS. 6–9, band 21 is diametrically adjustable to accommodate drum sizes of different diameters. Opposite ends portions 69 and 71 of band 21 have a plurality of adjustment holes 73 which are cooperatively spaced so that they can be selectively aligned in communicating relation with apertures in a mounting plate 23. Conventional bolt assemblies 75 extend through the apertures in mounting plate 23 and through the adjustment holes 73 in opposite end portions 69 and 71, thereby securing such opposite ends together to form the annular band 21 with a desired diameter.

Figure 6:
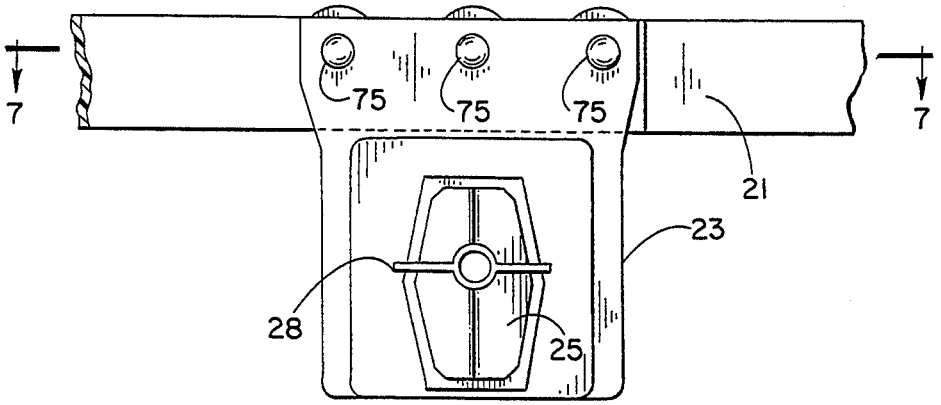
FIG. 6 is a partial front elevational view of my musical drum mounting bracket showing an adjustable mounting clamp which is carried by the mounting plate.
Figure 7:
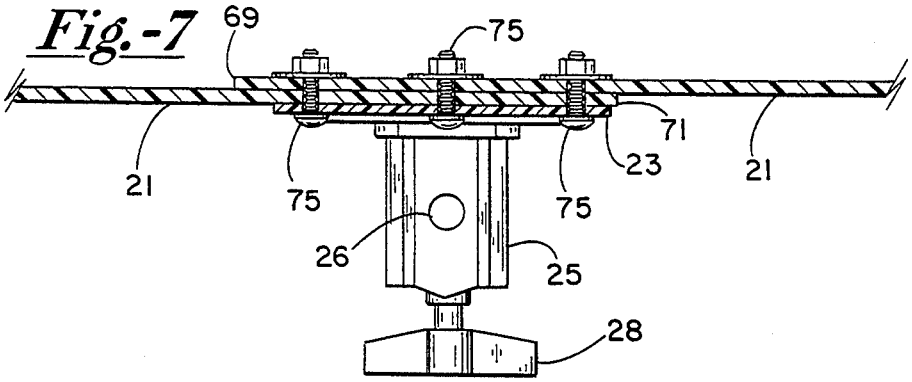
FIG. 7 is a sectional view taken along line 7—7 of FIG. 6, showing the overlapping ends of the annular band of my musical drum mounting bracket which provides for diametric adjustment thereof.
Figure 8:
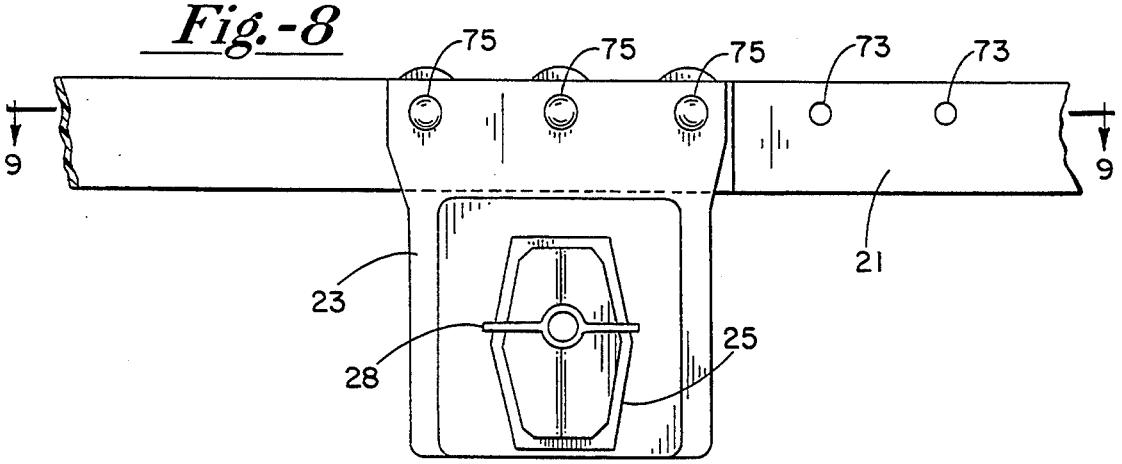
FIG. 8 is a partial front elevational view of my musical drum mounting bracket, showing the annular band being diamatrically adjusted to a larger diameter than that shown in FIG. 6.
Figure 9:
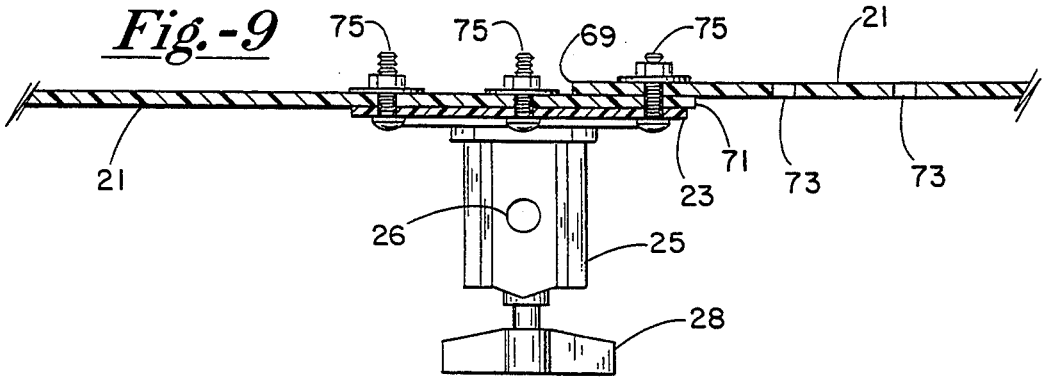
FIG. 9 is a cross-sectional view taken along line 9—9 of FIG. 8 showing an adjustment of the overlapping ends of the annular band of my musical drum mounting bracket to diametrically adjust the same.

As shown in FIGS. 6 and 7, opposite ends 69 and 71 of band 21 can overlap to reduce the diameter of band 21 for use in connection with smaller diameter musical drums. As shown in FIGS. 8 and 9, the relative positioning of opposite ends 69 and 71 of band 21 can be adjusted so as to increase the diameter of band 21 for use with larger drums. Increasing the diameter of band 21 causes opposite end portions 69 and 71 thereof to overlap less, or not overlap at all, yet continue to mate with the apertures in mounting plate 23 for securing the band 21 in an annular configuration around drum 1. In this manner, one band 21 can be used to support any of a variety of different sized drums, which is a distinct advantage over prior art devices.

As shown in FIG. 2, each support member 29 preferably comprises a pair of mounts 31 and 33 which are carried and readily movable on appropriate upper and lower edges of band 21. Mounts 31 and 33 are preferably constructed of an insulating plastic or polymeric material, such as santoprene, with a preferred durometer of hardness in the range of 40 to 95. Although the above materials and durometer values are preferred, it is contemplated that any material having insulative characteristics which is capable of reducing the grounding effect of the structure supporting the drum can be utilized in the manufacture of supports 29.

Mount 31 is constructed with a main body portion 35 having a central bore 37 extending therethrough. Extending radially outward (relative to band 21) from the main body portion 35 is a lip portion 39 which defines a groove 41 that straddles one edge of band 21. As can be seen from FIG. 2, mount 31 is readily slidably along the circumference of band 21 so as to be positionable at any desired location thereon.

Mount 33 is constructed with a similar main body portion 43 which has a central bore 45 extending therethrough. Extending radially outward from the main body portion 43 is lip portion 47 which defines groove 49 within which the opposite edge of band 21 is received. Bolt 51 having a keyed head 53 extends through opening 45 in the main body portion 43 of mount 33, and through opening 37 in the main body portion 35 of mount 31. Bolt 51 is threaded into securing nut 55, thereby drawing mounts 31 and 33 together and tightening the same to the annular band 21 at a desired location along the circumference thereof.

As shown clearly in FIG. 2, relative to band 21, mount 33 includes a radially inward protruding shoulder or finger 57 which has an angled free end portion 59 that extends toward opposite mount 31, thereby forming groove 61 with a drum bearing surface 63 upon which the lower counter hoop 11 of drum 1 may rest, when supported as shown in FIG. 1.

Mount 31 is constructed such that its radially innermost portion 64 is vertically from counter hoop 11 so as not to clamp thereto, and to leave counter hoop 11, and consequently drum 1, freely removable from the insulative supports 29 which support the same. As such, all insulative supports 29 are disposed in supportive, but disconnected and non-clamping relation to the musical drum 1.

As can be seen from the above, the diametric adjustability of band 21; the movability of supports 29 along the circumference of band 21; and the non-clamping manner in which such supports 29 engage drum 1 provide for an independent, highly versatile and efficient means for supporting musical drums of many different types and sizes, without the need for numerous specially constructed mounting brackets. The versatility of my new mounting bracket markedly reduces the manufacturing cost and expense of maintaining large inventory levels of such specially constructed mounting brackets, which must currently be maintained.

Figure 3:
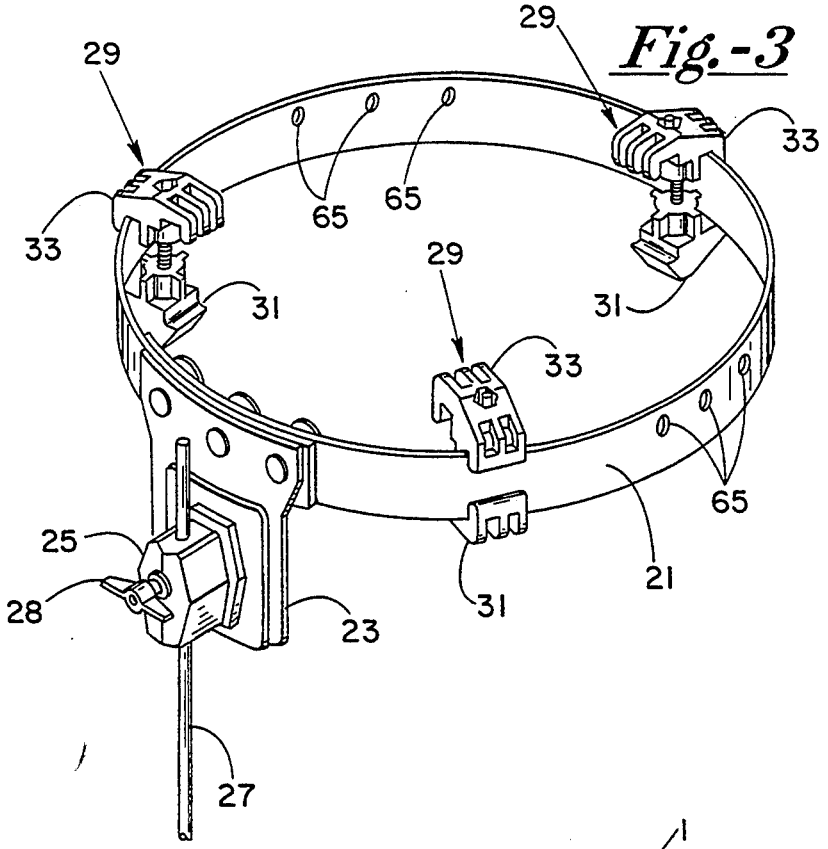
FIG. 3 is a perspective view of my musical drum mounting bracket in an inverted position for supporting a musical drum from its top counter hoop.
Figure 4:
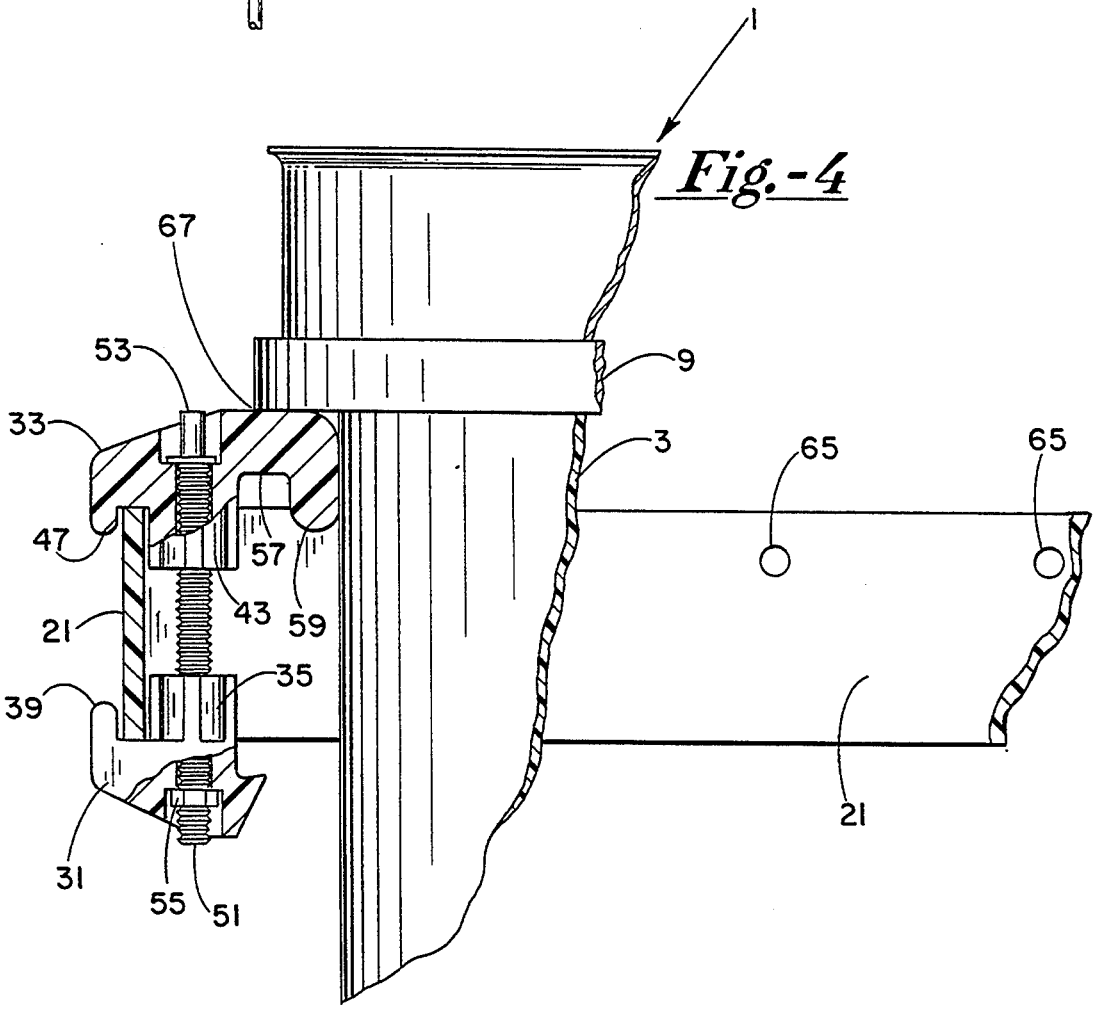
FIG. 4 is a cross-section of my musical drum mounting bracket as utilized in the configuration shown in FIG. 3, showing the manner in which the adjustable insulating supports support the musical drum from its top counter hoop.
Figure 5:
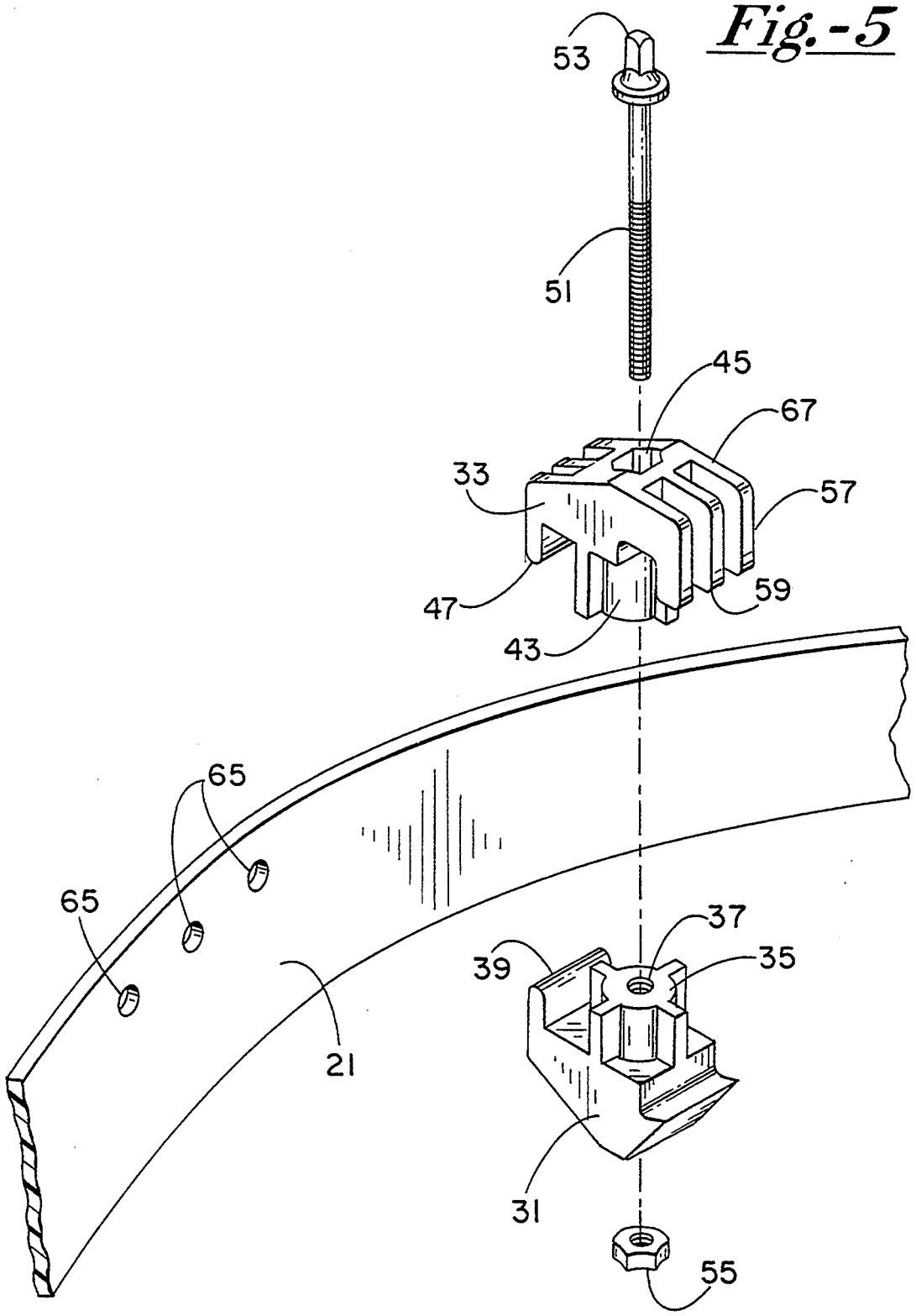
FIG. 5 is an exploded perspective view of the preferred embodiment of an adjustable insulating support, showing the manner in which such supports are constructed and carried by the circumferential band which encircles the drum.

As shown in FIGS. 3–5, my musical drum mounting bracket may also be inverted and used to support a conventional musical drum 1, such as a rack-mounted tom, from its upper counter hoop 9. As shown best in FIG. 3, a plurality of insulating support members 29 are carried on band 21 in readily movable relation along the circumference thereof. The support members 29 are spaced about the circumference of band 21 so as to provide support to drum 1, which is received within its annular confines. Such insulating drum support members 29 are disposed between adjacent head tightening lugs 13, and are devoid of any physical connection therewith.

Under certain circumstances, depending on the type and weight of the musical drum being mounted, only one mounting plate 23 may be necessary to support band 21.

As shown in FIG. 3, additional mounting holes 65 are provided in band 21 to accommodate additional mounting plates 23, which may be necessary for use with larger drums, such as a floor tom, similar to that shown in FIG. 1.

As best shown in FIGS. 3 and 4, inversion of my musical drum mounting bracket causes each of the insulating support members 29 to be inverted such that finger portion 57 of mount 33 curves downwardly. The upper counter hoop 9 of musical drum 1 now bears against surface 67 of finger portion 57 of each mount 33 which extends radially inward from band 21. Once again, there is no physical fixed connection between the counter hoop 9 of musical drum 1 and mount 33, and the drum is supported thereby in disconnected non-clamping relation. The musical drum 1 can be readily lifted from each of the insulative support members 29 and rotated as desired to change the bearing points on counter hoop 9, without the need for disassembly of the mounting bracket from the drum. Moreover, the musical drum, and mounting bracket can be easily separated for convenient transportation or storage of the drum in a standard sized drum case. No assembly and retuning is necessary, since the head tightening lugs 13 and 17 have not been tampered with.

Figure 10:
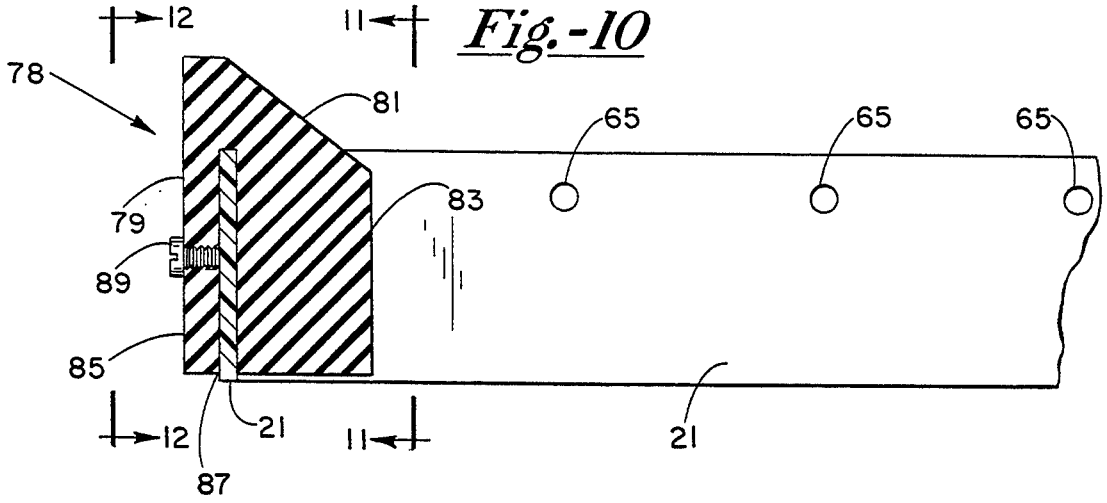
FIG. 10 is a first alternative embodiment of my musical drum mount which utilizes elastomeric adjustable insulating supports having a downwardly extending slit which straddles the annular band and is carried thereby.
Figure 11:
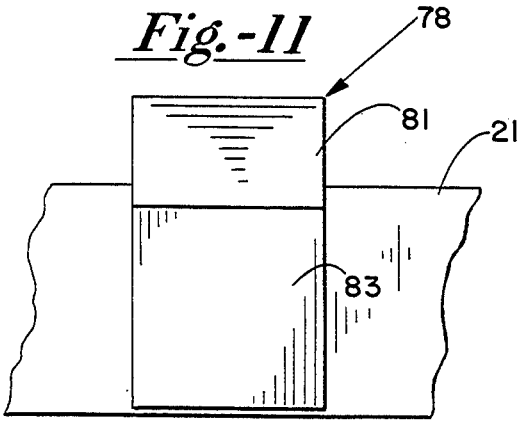
FIG. 11 is a front elevational view of the first alternative embodiment of an adjustable insulating support, as shown in FIG. 10.
Figure 12:
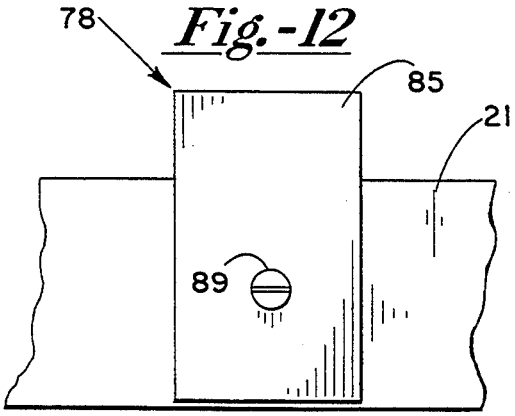
FIG. 12 is a rear elevational view of the first alternative embodiment of an adjustable insulating support, as shown in FIG. 10.

Shown in FIGS. 10–12 is an alternative embodiment of an insulating support member, designated as numeral 78, which is comprised of an elastomeric block 79 which has a tapered drum bearing surface 81. Although block 29 is shown as being made of an elastomeric material, such blocks could equally be made of a polymeric or other insulative material. Drum bearing surface 81 extends angularly upward and outward from the innermost surface 83 toward the outermost surface 85 of block 79. A downwardly opening slit 87 extends through block 79 in a plane parallel with the innermost surface 83 and outermost surface 85 thereof. As shown in FIG. 10, slit 87 straddles band 21 and is carried thereby in freely movable relation along the circumference thereof. Set screw 89 extends into the block 79 from the outermost surface 85 thereof, and is constructed so as to be tightenable against band 21 for securing block 79 thereto. With this alternative embodiment, the counter hoop 9 or 11 of drum 1 will rest upon the tapered drum bearing surface 81 in a disconnected and non-clamping relation, so as to be readily removable therefrom whenever desired. As block 79 is freely movable along the circumference of band 21, there is no physical fixed connection between block 79 and the head tightening lugs 13 or 17 of drum 1.

Figure 13:
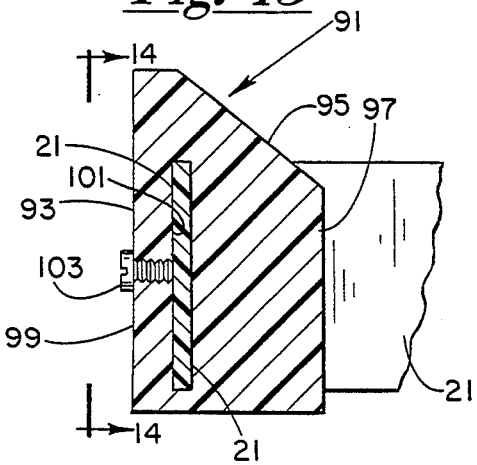
FIG. 13 is a cross-sectional view of a second alternative embodiment of an adjustable insulating support which has a central slot extending therethrough which receives the annular band of my musical drum mounting bracket.
Figure 14:
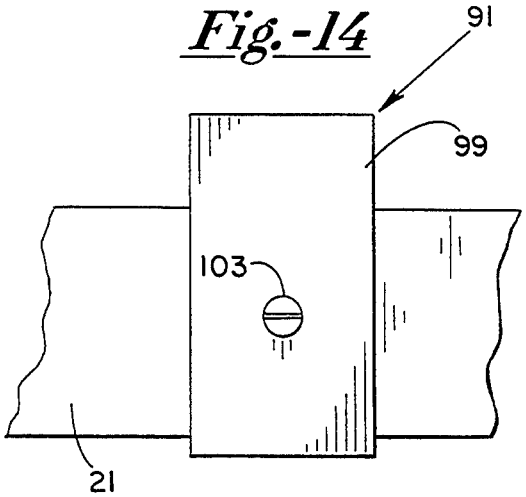
FIG. 14 is a rear elevational view of the second alternative embodiment of an adjustable insulating support, as shown in FIG. 13.

Shown in FIGS. 13 and 14 is a second alternative embodiment of an insulative support member, designated as numeral 91. Insulative support member 91 is comprised of an insulative plastic or polymeric block 93 which has a drum bearing surface 95 which similarly tapers upwardly and outwardly from the block's innermost surface 97 toward the outermost surface 99 thereof. Slot 101 extends through block 93 in a plane parallel to the innermost surface 97 and outermost surface 99 thereof, and is bounded on all sides by block 93. As shown in FIG. 13, band 21 extends through slot 101 so as to carry block 93 in readily slidable relation along the circumference of the band. Again, a set screw 103 is provided which extends into the outermost surface 99 of block 93 so as to bear against band 21 when tightened, and secure block 93 in any desired location along the circumference of the band.

In using insulative support member 91, the counter hoop 9 or 11 of a conventional drum will seat on and bear against the drum bearing surface 95 in disconnected and non-clamping relation, as previously described. Although not shown in the drawings, it is contemplated that drum bearing surface 95 could be formed of an elastomeric material, and be bonded to the insulative polymeric block 93, so as to provide enhanced insulative characteristics to the support members.

In operation, a conventional musical drum 1 may be either supported by its top counter hoop 9 or its bottom counter hoop 11 (if one exists) via use of any one of the insulative support members 29, 78 or 91 shown and described hereinabove. Each of the insulative support members are readily movable along the circumference of band 21, and because each of said insulative support members includes a drum bearing surface which disconnectedly engages the drum in non-clamping relation, such insulative support members can be readily moved to any desired position to most effectively support and tune the musical drum, as desired.

As no physical connection is made between the insulative support members and the musical drum, the entire musical drum mounting bracket can be separated from the drum without the need for disconnecting the head tightening lugs and counter hoop from the drum itself. Supporting the drum in disconnected and non-clamping relation marks a vast improvement over past supporting devices because of the substantial time saved in disassembly, reassembly and retuning of the musical drum, which is necessary when using such conventional supporting devices. The large range of diametric adjustability of supporting band 21 provides for optional use thereof with a wide variety of different sized drums. Moreover, because the insulative support members used with my new mounting bracket can be positioned in a multitude of locations around the circumference of the drum, there is no longer a need for special mounting brackets for each different drum model of the various manufacturers of such drums.

It will, of course, be understood that various changes may be made in the form, details, arrangement and proportions of the parts without departing from the scope of the invention which comprises the matter shown and described herein and set forth in the appended claims.

I claim:

1. A musical drum supporting apparatus for suspending a mounted tom from a supporting structure, comprising:

(a) a relatively rigid but flexible annular band defining a central opening for receiving a drum with an outer circumference therewithin, said band having means for mounting the same to the supporting structure;

(b) a plurality of drum support members carried by said band in readily movable and adjustable relation along the circumference thereof; and (c) said drum support members being selectively spacable about the circumference of said band for selective engagement of said drum at any of an infinite number of selectable support locations about said circumference thereof, each of said support members having a drum bearing surface which extends radially inwardly from said band so as to disconnectedly engage said drum received therewithin in non-clamping supporting relation.

2. The structure defined in claim 1, wherein each of said drum support members are constructed of a relatively insulative plastic material, and are slidably movable along the circumference of said band.

3. The structure defined in claim 1, wherein each of said drum support members includes a central opening through which said band passes, thereby carrying each of said drum support members in slidably movable relation thereon.

4. The structure defined in claim 1, wherein said band includes means for diametric adjustment thereof.

5. The structure defined in claim 1, wherein each of said drum support members includes means for clamping the same to said band at a desired location thereon.

6. The structure defined in claim 1, wherein at least said drum bearing surface of each of said drum support members is constructed of an elastomeric material.

7. The structure defined in claim 1, wherein each of said drum support members includes a radially innermost surface and a radially outermost surface, said drum bearing surface of each of said drum support members tapering radially outward and upward from said radially innermost surface towards said radially outermost surface thereof.

8. The structure defined in claim 7, wherein each of said drum support members includes a downwardly opening slit for receiving said band, said open slit being disposed between said radially innermost and outermost surfaces of each of said drum support members, and extending substantially parallel thereto.

9. A musical drum supporting apparatus for suspending a mounted tom from a support structure, comprising:

(a) a relatively rigid but flexible annular band defining a central opening for receiving the drum therewithin, said band having means for mounting the same to the supporting structure;

(b) a plurality of drum support members carried by said band in readily movable and adjustable relation along the circumference thereof;

(c) each of said drum support members being spaced about the circumference of said band and having a drum bearing surface which extends radially inwardly from said band so as to disconnectedly engage the drum received therewithin in non-clamping supporting relation; and (d) each of said drum support members including a slit which straddles said band in slidably movable relation therealong.

10. A musical drum supporting apparatus for suspending a mounted tom from a supporting structure, comprising:

(a) a relatively rigid but flexible annular band defining a central opening for receiving the drum therewithin, said band having means for mounting the same to the supporting structure;

(b) a plurality of drum support members carried by said band in readily movable and adjustable relation along the circumference thereof;

(c) each of said drum support members being spaced about the circumference of said band and having a drum bearing surface which extends radially inwardly from said band so as to disconnectedly engage the drum received therewithin in non-clamping supporting relation; and (d) said band has opposite ends, each of which includes a plurality of mounting holes which are constructed and arranged to cooperatively mate in various positions for diametric adjustment of said bands, said mounting holes providing means for connection of said band to the floor stand.

11. A musical drum supporting apparatus for suspending a mounted tom from a supporting structure, comprising:

(a) a relatively rigid but flexible annular band defining a central opening for receiving the drum therewithin, said band having means for mounting the same to the supporting structure;

(b) a plurality of drum support members carried by said band in readily movable and adjustable relation along the circumference thereof;

(c) each of said drum support members being spaced about the circumference of said band and having a drum bearing surface which extends radially inwardly from said band so as to disconnectedly engage the drum received therewithin in non-clamping supporting relation; and (d) said band has an upper and lower edge, each of said drum support members comprising an upper mount which engages said upper edge of said band, and a lower mount which engages said lower edge of said band, said upper and lower mounts being interconnected by a tightening means which allows securement of said mounts to said band at a desired location along the circumference thereof.

12. The structure defined in claim 11, wherein at least one of said mounts includes structure which extends radially inward from said band for supporting the drum received therewithin.

13. The structure defined in claim 12, wherein said structure of said mount which extends radially inwardly from said band for supporting the drum has a generally U-shaped cross-sectional configuration.

14. An apparatus for supporting a musical drum from a supporting structure, comprising:

(a) a drum with an outer generally cylindrical shell and an annular rim extending therearound and radially outward therefrom;

(b) a rigid but flexible annular band having a greater diameter than said outer shell of said drum and extending therearound, said band having means for suspending the same to the supporting structure;

(c) a plurality of drum support members carried by said band in spaced relation around the periphery thereof; and (d) said drum support members being selectively spacable about the circumference of said band for selective engagement of said drum at any of an infinite number of selectable support locations on said rim thereof, each of said drum support members having a drum bearing surface which extends radially inward from said band and engages said rim in non-clamping drum supporting relation, said band being devoid of any physical fixed connection to said drum.

15. The structure defined in claim 14, wherein each of said drum support members are constructed of a relatively insulative material and carried on said band in readily slidable relation thereto.

16. The structure defined in claim 14, wherein each of said drum support members has a radially innermost surface and a radially outermost surface, said drum bearing surface of each of said drum support members tapering radially outward and upward from said radially innermost surface toward said radially outermost surface thereof.

17. The structure defined in claim 14, wherein each of said drum support members includes an opening extending therethrough which receives said band therein, said band supporting and carrying each of said drum support members thereby.

18. The structure defined in claim 14, wherein said band includes means for diametric adjustment thereof.

19. The structure defined in claim 18, wherein said band has opposite ends which are constructed and arranged to overlap, each of said ends having a plurality of mounting holes extending therethrough, and at least some of said mounting holes on one of said ends being cooperatively aligned with some of said mounting holes on said opposite end so as to receive a securement means therethrough for firmly securing said opposite ends together at a desired band diameter.

20. The structure defined in claim 14, wherein at least a portion of said drum bearing surface of at least some of said drum support members are constructed of an elastomeric material.

21. The structure defined in claim 14, wherein said support members are constructed of a material which has a durometer in the approximate range of 40–95.

22. The structure defined in claim 14, wherein said band has an upper and lower edge, and each of said support members includes an upper mount which engages said upper edge of said band, and a lower mount which engages said lower edge of said band, said upper and lower mounts being secured together by an adjustable locking means for tightening said mounts to said band at a desired location thereon.

23. The structure defined in claim 21, wherein at least one of said mounts protrudes radially inwardly from said band toward said drum so as to provide said drum bearing surface which engages said rim.

24. The structure defined in claim 22, wherein the portion of said mount which extends inwardly to provide said drum bearing surface is generally U-shaped in cross sectional configuration.

25. An apparatus for supporting a drum having an outer rim from a supporting structure comprising:

(a) a rigid but flexible annular diametrically adjustable band defining a central opening for receiving a drum with an outer circumferential rim therewithin, said band having a mounting bracket secured thereto for mounting said band to the supporting structure;

(b) a plurality of drum support members carried by said band is spaced relation around the periphery thereof, and freely movable therealong; and (c) said drum support members being selectively positionable on said band for selective engagement of any of an infinite number of support locations on said rim of said drum, each of said drum support members having a drum bearing surface which extends radially inward from said band so as to disconnectedly engage said rim of said drum received therein in non-clamping drum supporting relation, at least said drum bearing surface of each of said drum support members being constructed of an insulating material.

26. The structure defined in claim 25, wherein each of said drum support members are generally solid and have radially inner and outer surfaces, with opposite side surfaces extending therebetween, each of said drum support members including an opening extending therethrough between said opposite side surfaces, said band extending through said opening and thereby carrying each of said drum support members in slidable relation therealong.

27. The structure defined in claim 25, wherein said opening comprises a central slot extending through each of said support members, said slot being bounded on all sides by said drum support member through which it extends.

28. The structure defined in claim 25, wherein each of said drum support members includes means for fixedly securing the same to said band at a desired location thereon.

29. The structure defined in claim 25, wherein said mounting bracket includes an adjustment means for vertically adjusting said band on the supporting structure.

30. The structure defined in claim 25, wherein said band has opposite ends, said opposite ends including means for adjustably securing the same to said mounting bracket at varying positions so as to diametrically adjust the band as desired.

31. An apparatus for supporting a drum having an outer rim from a supporting structure comprising:

(a) a rigid but flexible annular diametrically adjustable band defining a central opening for receiving the drum therewithin, said band having a mounting bracket secured thereto for mounting said band to the supporting structure;

(b) a plurality of drum support members carried by said band in spaced relation around the periphery thereof, and freely movable therealong;

(c) each of said drum support members having a drum bearing surface which extends radially inward from said band so as to disconnectedly engage the rim of the drum received therein in non-clamping drum supporting relation, at least said drum bearing surface of each of said drum support members being constructed of an insulating material; and (d) each of said drum support members including a slit, said slit opening downwardly and receiving said band therein such that each of said drum support members is carried by said band in slidable straddling relation thereon.

* * * * *